US008042749B2

(12) United States Patent
Son et al.

(10) Patent No.: US 8,042,749 B2
(45) Date of Patent: Oct. 25, 2011

(54) WASHER DEVICE FOR HEADLAMP FOR VEHICLE

(75) Inventors: Sung Won Son, Incheon (KR); Young Jun Suh, Yongin-si (KR)

(73) Assignee: Hyundai Motor Company, Seoul (KR)

( * ) Notice: Subject to any disclaimer, the term of this patent is extended or adjusted under 35 U.S.C. 154(b) by 220 days.

(21) Appl. No.: 12/476,665

(22) Filed: Jun. 2, 2009

(65) Prior Publication Data

US 2010/0133357 A1 Jun. 3, 2010

(30) Foreign Application Priority Data

Dec. 3, 2008 (KR) ..... 10-2008-0121884

(51) Int. Cl.
*B05B 1/10* (2006.01)

(52) U.S. Cl. ..... 239/284.1; 239/284.2

(58) Field of Classification Search ..... 239/284.1, 239/284.2, 225.1, 226, 237, 255, 236; 15/250.01, 15/250.002

See application file for complete search history.

(56) References Cited

U.S. PATENT DOCUMENTS

| | | | | |
|---|---|---|---|---|
| 3,656,691 | A * | 4/1972 | Norstrand | 239/284.2 |
| 6,955,306 | B2 * | 10/2005 | Salvador et al. | 239/284.1 |
| 7,014,131 | B2 * | 3/2006 | Berning et al. | 239/589.1 |
| 7,434,748 | B2 * | 10/2008 | Takada et al. | 239/284.2 |
| 2004/0251315 | A1 * | 12/2004 | Maruyama et al. | 239/284.1 |
| 2007/0045446 | A1 * | 3/2007 | Amron | 239/237 |

* cited by examiner

*Primary Examiner* — Davis Hwu

(74) *Attorney, Agent, or Firm* — Morgan, Lewis & Bockius LLP

(57) ABSTRACT

Disclosed is an economical washer device of a headlamp for a vehicle includes a nozzle unit integrally mounted onto a nozzle cover, the nozzle unit including a washer discharging opening and a washer introducing opening, wherein a washer liquid is fed through the washer introducing opening and selectively discharged through the discharging opening, and a slide drive unit integrated with the nozzle unit and configured and dimensioned to rotatably support the nozzle unit when the nozzle unit is rotated by an ejection pressure of the washer liquid discharged.

15 Claims, 4 Drawing Sheets

WASHER DEVICE FOR HEADLAMP FOR VEHICLE

CROSS-REFERENCE TO RELATED APPLICATION

The present application claims priority to Korean Patent Application Number 10-2008-0121884 filed Dec. 3, 2008, the entire contents of which application is incorporated herein for all purposes by this reference.

BACKGROUND OF THE INVENTION

1. Field of the Invention

The present invention relates to a washer device of a headlamp for a vehicle, and more particularly, to a washer device of a headlamp for a vehicle that opens a nozzle cover to which a nozzle unit is integrally mounted by using a washer liquid circulating structure inside the nozzle unit and the hydraulic pressure of a washer motor.

2. Description of Related Art

In general, headlamps of high luminance are mounted to opposite lateral sides of the front of a vehicle in order to allow a driver to secure a sufficient visual field when there is a difficulty in securing a visual field during night or due to foggy, snowy, or rainy weather.

In recent years, washer devices are increasingly mounted to headlamps of high luminance such as HID headlamps in order to solve a problem in securing a frontal visual field caused by contamination of lens surfaces of the headlamps like washer devices applied to windshield glasses.

Currently, separate telescopes are being applied to washer devices of headlamps for almost all vehicles in order to solve problems such as blocking of ejection nozzles due to introduction of foreign substances.

Since such a washer device of a headlamp for a vehicle uses a separate cover, it has an excellent appearance. In addition, since it solves blocking of an ejection nozzle due to introduction of foreign substances, it is excellent in quality.

Korean Patent Laid-Open No. 2006-61540 discloses a washer device of a headlamp in which a rotary motor and a rotational force transferring mechanism are separately used instead of a telescope.

However, a washer device of a headlamp to which a telescope is applied needs a gap between a housing and a piston for upward and downward movement of the piston, and when moisture introduced into the gap is frozen, the operation of the washer device becomes impossible, secondarily causing loosing of a bumper and a nozzle cover and unsafe closing drive of a cover after use of the washer device.

In addition, such a washer device requires a telescope, a separate bracket for fixing the telescope, a housing, and a piston, causing additional costs.

Moreover, since Korean Patent Laid-Open No. 2006-61540 has a problem in that the rotational force transferring mechanism is corroded by a washer liquid introduced between a bumper and a nozzle cover or moisture introduced during washing of the vehicle or in a rainy day, a separate cover for preventing introduction of moisture needs to be mounted to a gear unit and a fixing bracket, causing disadvantages in the aspect of layout and additional costs.

Furthermore, since the nozzle cover is opened and closed by applying a separate rotary drive motor for driving the rotational force transferring mechanism, a motor is required in addition to a washer motor, causing disadvantages in weight and costs.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provides an economical washer device of a headlamp for a vehicle in which a nozzle unit is integrally mounted to a nozzle cover and a washer liquid is ejected as the nozzle cover is opened when a slide drive unit is automatically rotated and driven using the washer liquid circulation structure inside the nozzle unit and the hydraulic pressure of a washer liquid.

In an aspect of the present invention, the washer device of a headlamp for a vehicle may include a nozzle unit integrally mounted onto a nozzle cover, the nozzle unit including a washer discharging opening and a washer introducing opening, wherein a washer liquid is fed through the washer introducing opening and selectively discharged through the discharging opening, and a slide drive unit integrated with the nozzle unit and configured and dimensioned to rotatably support the nozzle unit when the nozzle unit is rotated by an ejection pressure of the washer liquid discharged.

The nozzle unit may include a valve disposed in a housing, an elastic member, one side of which is fixed to the valve and the other side of which is fixed to the housing so as to elastically support the valve, and a washer liquid circulating channel having an input passage fluid-connected to the washer liquid introducing opening and an output passage fluid-connected to the washer liquid discharging opening, wherein the valve is disposed between the input passage and the output passage and configured and dimensioned to selectively block a fluid flow therebetween according to an elastic force of the elastic member and a pressure of the washer liquid introduced through the washer liquid introducing opening.

An ejection nozzle may be disposed between the valve and the washer liquid discharging opening to form the output passage of the washer liquid circulating channel, wherein the ejection nozzle is aligned along a tangential direction of a rotational locus of the nozzle unit.

The washer liquid circulating channel of the nozzle unit may be provided on the opposite side of the elastic member with respect to the valve, in which the washer liquid introducing opening is formed in a central portion of the housing in a lateral side thereof, and in which washer liquid discharging opening is spaced from the washer liquid introducing opening with a predetermined distance in a lateral direction of the housing.

The nozzle unit may further include a valve stopper configured and dimensioned to receive the valve between the valve stopper and the ejection nozzle to restrict a movement locus of the valve.

In another aspect of the present invention, the slide drive unit may include a lower guide bracket fixed to a vehicle body, and an operation bracket slidably coupled to the lower bracket and to which the nozzle unit is integrally mounted so that nozzle unit mounted to the operation bracket is slidably guided along a contour of the lower guide bracket, wherein the operation bracket includes a first guide groove to which the lower guide bracket is slidably coupled and wherein the operation bracket include a front protrusion and a rear protrusion spaced each other with a predetermined distance and the lower guide bracket includes stopper-mounting holes to receive stoppers therein so that a movement distance of the operating bracket is limited within a predetermined distance of the stoppers.

The first and second protrusions of the operation bracket may be disposed between the stoppers of the lower guide bracket, The lower guide bracket may include a plurality of stopper-mounting holes to receive the stoppers therein so that the movement distance of the operating bracket can be adjusted, wherein the cross section of the first and second protrusions is smaller than the cross section of the stopper-mounting holes, In further another aspect of the present invention, the washer device may further include an upper guide bracket fixed to the lower guide bracket to slidably receive the operation bracket therebetween, wherein the upper guide bracket includes a guide slot formed along a longitudinal direction of the upper guide bracket so that the nozzle unit is fixed to the operation bracket through the guide slot and slides along the guide slot without interference, wherein a nozzle mounting hole is formed in the operation bracket so that a bottom portion of the nozzle unit is inserted and fixed therethrough and wherein the upper guide bracket includes a second guide groove into which the operation bracket is slidably coupled so that the operation bracket is slidably guided between the upper and lower guide brackets.

As mentioned above, since the washer device of a headlamp for a vehicle according to the present invention is driven in a rotary manner using an ejection pressure of a washer liquid instead of being driven by a telescope or a rotary drive motor, it is advantageous in the aspects of layout and costs.

The methods and apparatuses of the present invention have other features and advantages, which will be apparent from or are set forth in more detail in the accompanying drawings, which are incorporated herein, and the following Detailed Description of the Invention, which together serve to explain certain principles of the present invention.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

Figure 1:
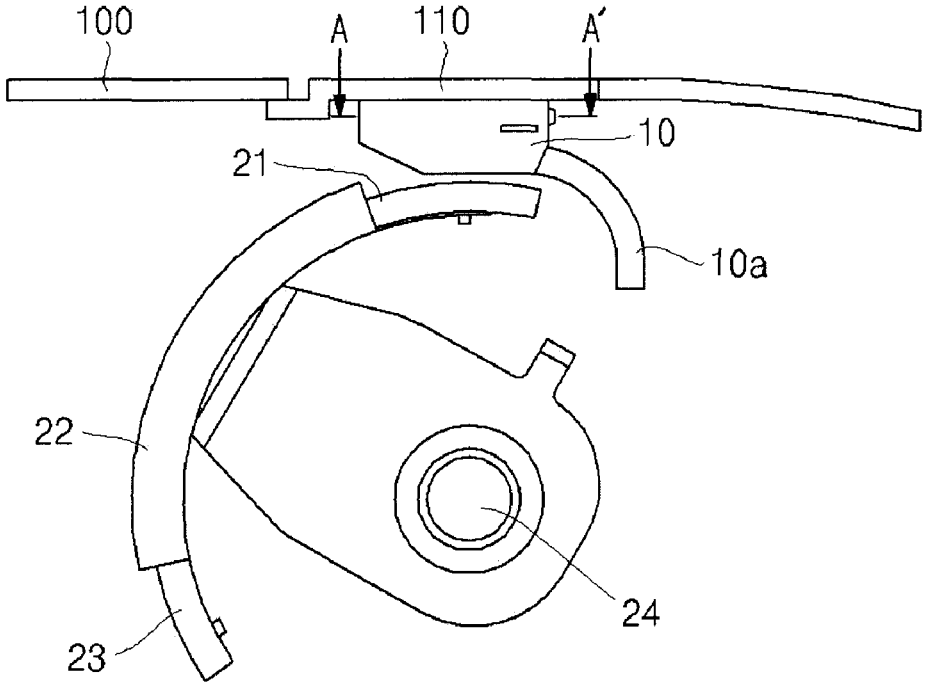
FIG. 1 is a side view illustrating an exemplary washer device of a headlamp for a vehicle according to the present invention.
Figure 2:
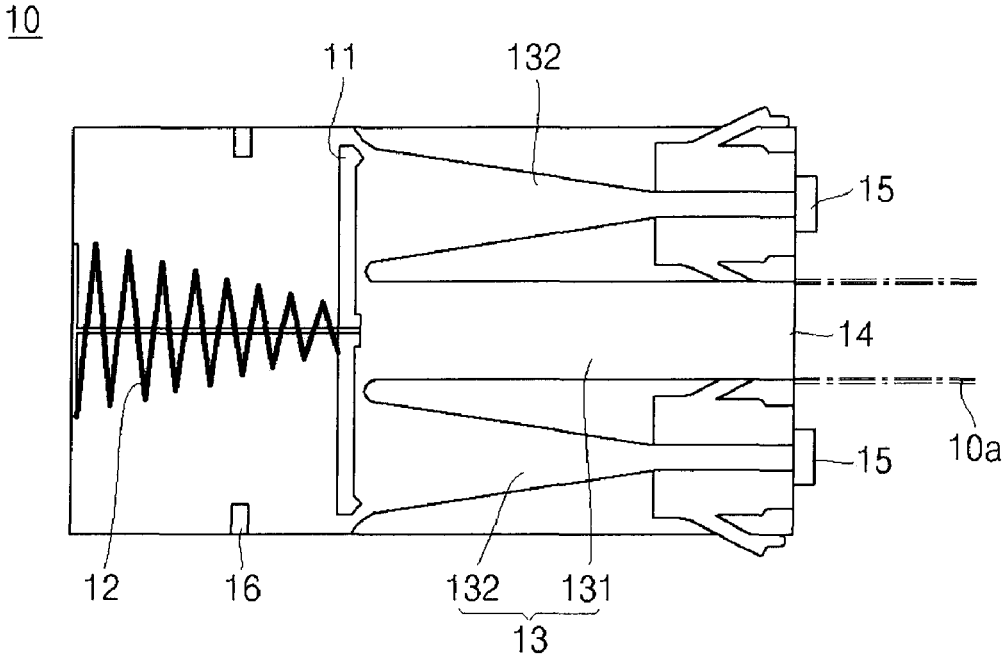
FIG. 2 is a sectional view taken along line A-A' of FIG. 1.
Figure 3:
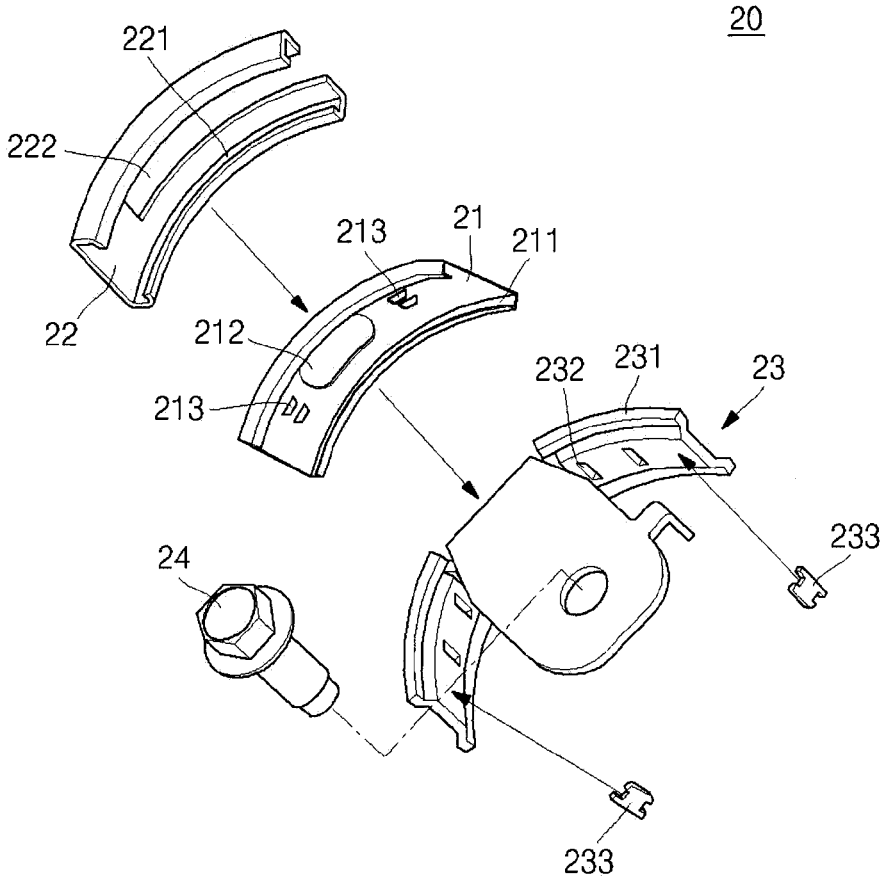
FIG. 3 is an exploded perspective view illustrating an exemplary slide drive unit according to the present invention.
Figure 4:
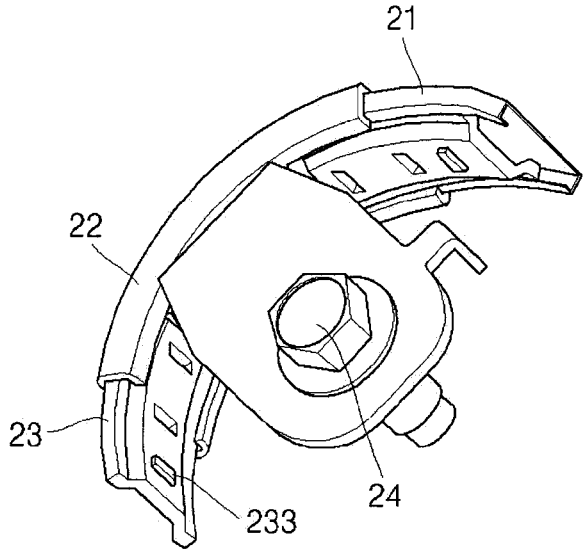
FIG. 4 is a perspective view illustrating the slide drive unit according to the present invention.

FIG. 1 is a side view illustrating an exemplary washer device of a headlamp for a vehicle according to the present invention. FIG. 2 is a sectional view taken along line A-A' of FIG. 1. FIG. 3 is an exploded perspective view illustrating a slide drive unit according to the present invention. FIG. 4 is a perspective view illustrating the slide drive unit according to the present invention.

The present invention relates to an economical washer device of a headlamp for a vehicle in which a nozzle unit 10 is integrally mounted into a nozzle cover 110 and which drives a nozzle unit 10 and a slide drive unit 20 by removing a conventional telescope or rotary drive motor and using a washer liquid circulating structure inside the nozzle unit 10 and the hydraulic pressure of a washer motor.

As illustrated in FIG. 1, the washer device includes a nozzle unit 10 integrally mounted into a nozzle cover 110 and to which a nozzle pipe 10*a* through which a washer liquid is fed is connected and a slide drive unit 20 integrated with the nozzle unit 10 and exposing an ejection nozzle to the outside when it is rotated by the ejection pressure of a washer liquid during the operation of a washer switch.

As illustrated in FIG. 2, a conic compression spring 12 is fixed to the rear wall of the nozzle unit 10 and a plate-like valve 11 is installed in front of the compression spring 12. A washer liquid circulating channel 13 is provided on the other side of the compression spring 12 with respect to the valve 11.

A washer liquid introducing opening 14 is provided in a central passage 131 of the washer liquid circulating channel 13, and a washer liquid discharging opening 15 is provided in side passages 132 formed on opposite sides of the central passage 131.

In a normal state, the central passage 131 and the side passages 132 are blocked from each other by the valve 11. On the other hand, during the operation of a washer switch, the valve 11 is opened to the position of a valve stopper 16 by the pressure of the introduced washer liquid so that the central passage 131 can be communicated with the side passages 132.

In the structure of the nozzle unit 10, after the washer liquid is introduced into the nozzle unit 10, the slide drive unit 20 is rotated by itself in a round configuration by the hydraulic pressure of the washer liquid while presses the valve 11 inside the nozzle unit 10 against the elastic force of the compression spring 12 and is discharged to the outside to be ejected through an ejection nozzle 132.

As illustrated in FIGS. 3 and 4, the slide drive unit 20 includes an operation bracket 21 having a rounded plate-like shape to which the nozzle unit 10 is integrally mounted and having first guide grooves 211 on opposite sides thereof, an upper guide bracket 22 having second guide grooves 221 into which the operation bracket 21 are inserted so that the operation bracket 21 can be slidably guided and being located on the upper guide bracket 22, and a lower guide bracket 23 having fixing brackets 231 inserted into the first guide grooves 211 of the operation bracket 21 so that the operation bracket 21 can be slidably guided along the lower guide bracket 23.

The upper guide bracket 22 is fixed to the lower guide bracket 23 which is attached to a stationary member such as a vehicle body by a bolt 24 so that the operation bracket 21 disposed between the upper guide bracket 22 and the lower guide bracket 23 can move relatively therebetween.

In various embodiments of the present invention, the upper guide bracket 22 may be removed so that the operation bracket 21 is slidably guided only along the lower guide bracket 23.

A nozzle mounting hole 212 is formed in the operation bracket 21 so that the nozzle unit 10 can be inserted therethrough to be fixed, and ribs 213 restricting slide of the operation bracket 21 are formed on front and rear sides of the nozzle mounting hole 212 in the operation bracket 21.

A guide slot 222 along which the nozzle unit 10 is guided is formed in the upper guide bracket 22 along the lengthwise direction of the upper guide bracket 22 so that the nozzle unit 10 and the operation bracket 21 can be slid upward and downward without interference.

Slotted stopper mounting holes 232 through which stoppers 233 are inserted to be fixed are disposed in the lower guide bracket 23 at an interval along the lengthwise direction of the lower guide bracket 23, so that when the ribs 213 of the operation bracket 21 are caught and interfered with by the stoppers 233, the radius of rotation of the operation bracket 21 is restricted.

Hereinafter, the principle of the washer device of a headlamp for a vehicle including the nozzle unit 10 and the slide drive unit 20 will be described in detail with reference to the accompanying drawings.

Figure 5:
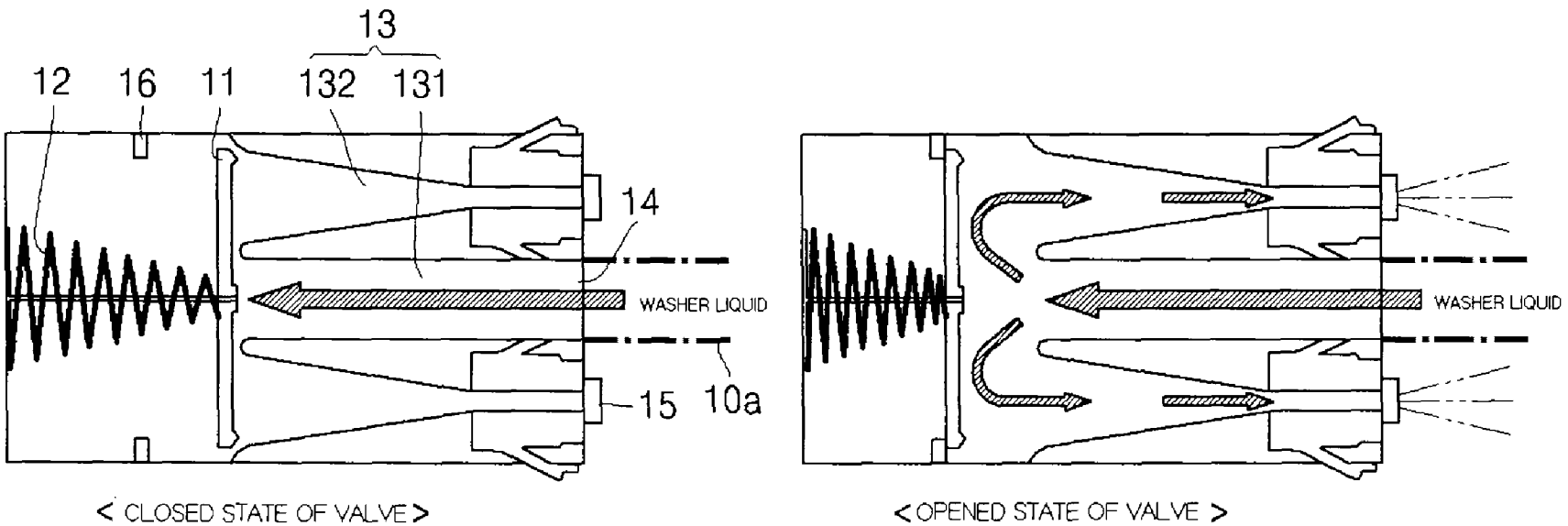
FIG. 5 is a view illustrating the operation of an exemplary nozzle unit according to the present invention.
Figure 6:
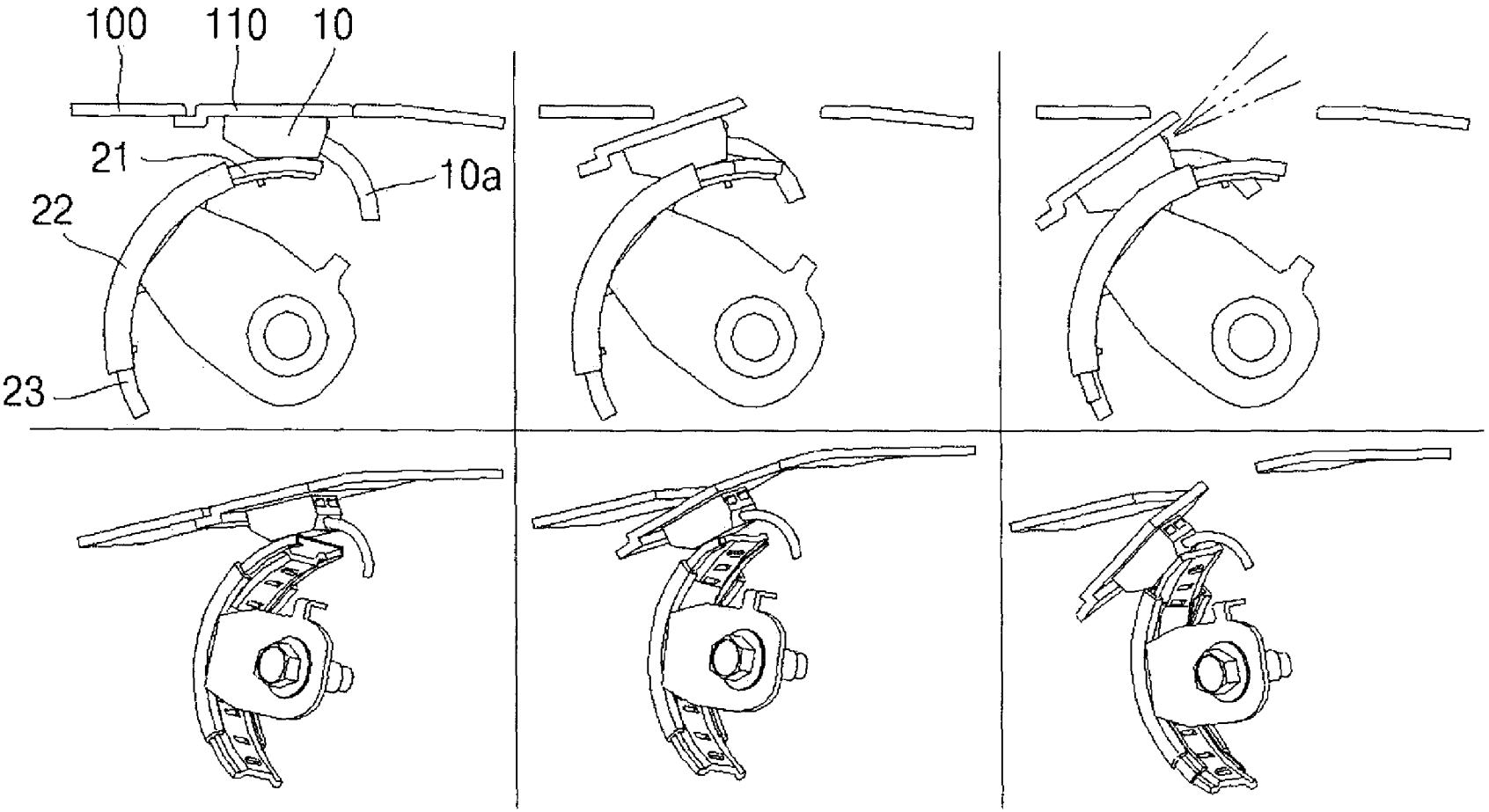
FIG. 6 is a view illustrating the operation of the exemplary washer device of a headlamp for a vehicle according to the present invention.

FIG. 5 is a view illustrating the operation of the nozzle unit 10 according to the present invention, and FIG. 6 is a view illustrating the operation of the washer device of a headlamp for a vehicle according to the present invention.

The present invention has a structure by which operation time is delayed so that a washer liquid cannot be ejected until the operation bracket 21 is rotated along the upper and lower guide brackets 22 and 23 by the operation of the mechanical valve 11 until the ribs 213 of the operation bracket 21 are stopped by the stoppers 233 fixed to the lower guide bracket 23. As illustrated in FIGS. 5 and 6, when the washer liquid is introduced into the nozzle unit by a strong pressure during the operation of the washer motor after the washer switch is operated, the washer liquid is ejected to the outside of the nozzle unit 10 via the washer liquid circulating channel 13 by the washer liquid structure.

Then, after the washer liquid is introduced into the nozzle unit 10 and presses the valve 11 of the nozzle unit 10, the nozzle unit 10 and the operation bracket 21 of the slide drive unit 20 are rotated along the upper and lower guide brackets 22 and 23 while the valve 11 is opened and the washer liquid is discharged to the outside through the passage.

Here, since the resilient force of the compression spring 12 supporting the valve 11 inside the nozzle unit 10 sets the applied force by which the operation bracket 21 of the slide drive unit 20 is rotated to be higher, the valve 11 is not opened during the rotation of the operation bracket 21.

In this state, if the nozzle unit 10 is not rotated further by the catching structure of the ribs 213 of the operation bracket 21 and the stoppers 233 of the lower guide bracket 23 while the operation bracket 21 is being rotated by the pressure of the washer liquid, the pressure of the washer liquid overcomes the resilient force of the compression spring 12 and the valve 11 is moved rearward at the same time.

Accordingly, when the central passage 131 and the side passages 132 are communicated with each other, the washer liquid is ejected.

The ejection angle and time of the washer liquid are adjusted by the positions of the stoppers 233 of the lower guide bracket 23 and the shape of the nozzle unit 10 and the slide drive unit 20.

The nozzle unit 10 may be return to its original position by an elastic member that may be coupled to an end portion of the operation bracket 21 after the pressure of the washer liquid is reduced.

For convenience in explanation and accurate definition in the appended claims, the terms "upper", "lower", "front", and "rear" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A washer device of a headlamp for a vehicle comprising:

a nozzle unit integrally mounted onto a nozzle cover, the nozzle unit including a washer discharging opening and a washer introducing opening, wherein a washer liquid is fed through the washer introducing opening and selectively discharged through the discharging opening; and a slide drive unit integrated with the nozzle unit and configured and dimensioned to rotatably support the nozzle unit when the nozzle unit is rotated by an ejection pressure of the washer liquid discharged;

wherein the slide drive unit includes:

a lower guide bracket fixed to a vehicle body; and an operation bracket slidably coupled to the lower bracket and to which the nozzle unit is integrally mounted so that nozzle unit mounted to the operation bracket is slidably guided along a contour of the lower guide bracket.

2. The washer device of claim 1, wherein the nozzle unit includes:

a valve disposed in a housing;

an elastic member, one side of which is fixed to the valve and the other side of which is fixed to the housing so as to elastically support the valve; and a washer liquid circulating channel having an input passage fluid-connected to the washer liquid introducing opening and an output passage fluid-connected to the washer liquid discharging opening, wherein the valve is disposed between the input passage and the output passage and configured and dimensioned to selectively block a fluid flow therebetween according to an elastic force of the elastic member and a pressure of the washer liquid introduced through the washer liquid introducing opening.

3. The washer device of claim 2, wherein an ejection nozzle is disposed between the valve and the washer liquid discharging opening to form the output passage of the washer liquid circulating channel.

4. The washer device of claim 3, wherein the ejection nozzle is aligned along a tangential direction of a rotational locus of the nozzle unit.

5. The washer device of claim 2, wherein the washer liquid circulating channel of the nozzle unit is provided on the opposite side of the elastic member with respect to the valve, in which the washer liquid introducing opening is formed in a central portion of the housing in a lateral side thereof, and in which washer liquid discharging opening is spaced from the washer liquid introducing opening with a predetermined distance in a lateral direction of the housing.

6. The washer device of claim 2, wherein the nozzle unit further includes a valve stopper configured and dimensioned to receive the valve between the valve stopper and the ejection nozzle to restrict a movement locus of the valve.

7. The washer device of claim 1, wherein the operation bracket includes a first guide groove to which the lower guide bracket is slidably coupled.

8. The washer device of claim 1, wherein the operation bracket include a front protrusion and a rear protrusion spaced each other with a predetermined distance and the lower guide bracket includes stopper-mounting holes to receive stoppers therein so that a movement distance of the operating bracket is limited within a predetermined distance of the stoppers.

9. The washer device of claim 8, wherein the first and second protrusions of the operation bracket are disposed between the stoppers of the lower guide bracket.

10. The washer device of claim 8, wherein the lower guide bracket includes a plurality of stopper-mounting holes to receive the stoppers therein so that the movement distance of the operating bracket can be adjusted.

11. The washer device of claim 10, wherein the cross section of the first and second protrusions is smaller than the cross section of the stopper-mounting holes.

12. The washer device of claim 1, further including an upper guide bracket fixed to the lower guide bracket to slidably receive the operation bracket therebetween, wherein the upper guide bracket includes a guide slot formed along a longitudinal direction of the upper guide bracket so that the nozzle unit is fixed to the operation bracket through the guide slot and slides along the guide slot without interference.

13. The washer device of claim 12, wherein a nozzle-mounting hole is formed in the operation bracket so that a bottom portion of the nozzle unit is inserted and fixed therethrough.

14. The washer device of claim 12, wherein the upper guide bracket includes a second guide groove into which the operation bracket is slidably coupled so that the operation bracket is slidably guided between the upper and lower guide brackets.

15. A passenger vehicle comprising the washer device of claim 1.

* * * * *